US011462184B2

(12) United States Patent
Chang et al.

(10) Patent No.: US 11,462,184 B2
(45) Date of Patent: Oct. 4, 2022

(54) DRIVING METHOD, DRIVING DEVICE AND RELATED LCD DISPLAY DEVICE

(71) Applicant: TCL CHINA STAR OPTOELECTRONICS TECHNOLOGY CO., LTD., Shenzhen (CN)

(72) Inventors: Bobiao Chang, Shenzhen (CN); Yichien Wen, Shenzhen (CN)

( * ) Notice: Subject to any disclaimer, the term of this patent is extended or adjusted under 35 U.S.C. 154(b) by 184 days.

(21) Appl. No.: 16/645,759

(22) PCT Filed: Jan. 10, 2020

(86) PCT No.: PCT/CN2020/071441

§ 371 (c)(1),
(2) Date: Mar. 9, 2020

(87) PCT Pub. No.: WO2021/128500

PCT Pub. Date: Jul. 1, 2021

(65) Prior Publication Data

US 2021/0407443 A1 Dec. 30, 2021

(30) Foreign Application Priority Data

Dec. 25, 2019 (CN) ..... 201911357536.8

(51) Int. Cl.
*G09G 3/36* (2006.01)

(52) U.S. Cl.
CPC ..... *G09G 3/3607* (2013.01); *G09G 2310/08* (2013.01); *G09G 2320/0252* (2013.01); *G09G 2320/066* (2013.01); *G09G 2360/12* (2013.01); *G09G 2360/18* (2013.01)

(58) Field of Classification Search
CPC ..... G09G 3/3607; G09G 2310/08; G09G 2320/0252; G09G 2320/066; G09G 2360/12; G09G 2360/18
See application file for complete search history.

(56) References Cited

U.S. PATENT DOCUMENTS

2020/0111405 A1* 4/2020 Kim ..... G09G 3/2092
2021/0174762 A1* 6/2021 Sun ..... G09G 3/20

* cited by examiner

*Primary Examiner* — Kenneth B Lee, Jr.
(74) *Attorney, Agent, or Firm* — JMB Davis Ben-David

(57) ABSTRACT

A driving method, a driving device and a liquid crystal display device are provided. The driving device of the LCD display device outputs the target grey value of the nth frame according to the original grey value of the nth frame, the original grey value of the (n−1)th frame and the look-up table. This improves the luminance of the sub-pixel of the nth frame, shortens the required charging time of the sub-pixel when the (n+1)th frame is being displayed. Thus, the sub-pixel of the (n+1)th frame could be efficiently charged and the luminance of the sub-pixel could be increased. In addition, since the luminance increase of the (n+1)th frame is more than that of the nth frame, the contrast of the LCD display could be improved.

15 Claims, 2 Drawing Sheets

DRIVING METHOD, DRIVING DEVICE AND RELATED LCD DISPLAY DEVICE

CROSS-REFERENCE TO RELATED APPLICATIONS

This is the U.S. National Stage of International Patent Application No. PCT/CN2020/071441 filed Jan. 10, 2020, which in turn claims the benefit of Chinese Patent Application No. 201911357536.8 filed Dec. 25, 2019.

FIELD OF THE INVENTION

The present invention relates to a display technique, and more particularly, to a driving method, a driving device and a related liquid crystal display (LCD) display device.

BACKGROUND OF THE INVENTION

Please refer to FIG. 1. FIG. 1 is a diagram of a conventional driving module. The driving module comprises a frame buffer 10 and a processor 20. The processor 20 receives original grey value data of a current image Cur-image, obtains original grey value data of a previous image Pre-image, outputs target grey value data of the current image Cur-image according to the original grey value data of the current image Cur-image, the original grey value data of the previous image Pre-image and a look-up table, and realize the over-driving display of the current image Cur-image according to the target grey value data of the current image Cur-image. For example, assume the grey value of a sub-pixel of the current image Cur-image is 50 and the grey value of the sub-pixel of the previous image Pre-image is 20. In the look-up table, the target grey value of the current image Cur-image is 55 when the display switch from the previous image Pre-image to the current image Cur-image. This is to shorten the response time for switching from the previous image Pre-image to the current image Cur-image. However, as the refreshing frequency of the display is migrated from 60 Hz to 120 Hz, the response time needs to be further shortened because the refreshing frequency for switching from dark screen to bright screen becomes higher. The short response time may ruin the display quality because the capacitor does not have enough time to be charged due to the short response time.

Therefore, a solution is required to solve the above-mentioned issue of the high refreshing frequency that introduces insufficient charging time to ruin the display quality.

SUMMARY OF THE INVENTION

One objective of an embodiment of the present invention is to provide a driving method, a driving device, and an LCD display, to solve the above-mentioned issue of the high refreshing frequency that introduces insufficient charging time to ruin the display quality.

According to an embodiment of the present invention, a driving method is disclosed. The driving method comprises: obtaining an original grey value of each sub-pixel of a (n+1)th frame and an original grey value of each sub-pixel of a nth frame; comparing the original grey value of each sub-pixel of the (n+1)th frame with a high grey value threshold and comparing the original grey value of each sub-pixel of the nth frame with a low grey value threshold; if the original grey value of each sub-pixel of the (n+1)th frame is higher than with the high grey value threshold and the original grey value of each sub-pixel of the nth frame is lower than the low grey value threshold, then adjusting the original grey value of each sub-pixel of the nth frame to be a predetermined grey value and outputting adjusted original grey value of each sub-pixel of the nth frame; obtaining an original grey value of each sub-pixel of (n−1)th frame and the adjusted original grey value of each sub-pixel of the nth frame; and outputting a target grey value of each sub-pixel of the nth frame according to the adjusted original grey value of each sub-pixel of the nth frame, an original grey value of each sub-pixel of the (n−1)th frame and a look-up table; wherein the predetermined grey value is higher than the low grey value threshold and lower than the high grey value threshold and n is an integer higher than 2.

Optionally, the step of obtaining the original grey value of each sub-pixel of the (n+1)th frame and the original grey value of each sub-pixel of the nth frame comprises: obtaining the original grey value of each sub-pixel of the nth frame from a first storage circuit.

Optionally, the driving method further comprises: after obtaining the original grey value of each sub-pixel of the nth frame from a first storage circuit, storing the original grey value of each sub-pixel of the (n+1)th frame into the first storage circuit.

Optionally, the step of obtaining the original grey value of each sub-pixel of (n−1)th frame and the adjusted original grey value of each sub-pixel of the nth frame comprises: obtaining the original grey value of each sub-pixel of the (n−1)th frame from a second storage circuit.

Optionally, the driving method further comprises: after obtaining the original grey value of each sub-pixel of the (n−1)th frame from a second storage circuit, outputting the original grey value of each sub-pixel of the nth frame to the second storage circuit.

According to an embodiment of the present invention, a driving device is disclosed. The driving device comprises: a first obtaining circuit, configured to obtain an original grey value of each sub-pixel of a (n+1)th frame and an original grey value of each sub-pixel of a nth frame; a first processing circuit, configured to compare the original grey value of each sub-pixel of the (n+1)th frame with a high grey value threshold, to compare the original grey value of each sub-pixel of the nth frame with a low grey value threshold, and to adjust the original grey value of each sub-pixel of the nth frame to be a predetermined grey value and output adjusted original grey value of each sub-pixel of the nth frame if the original grey value of each sub-pixel of the (n+1)th frame is higher than with the high grey value threshold and the original grey value of each sub-pixel of the nth frame is lower than the low grey value threshold; a second obtaining circuit, configured to obtain an original grey value of each sub-pixel of (n−1)th frame and the adjusted original grey value of each sub-pixel of the nth frame; and a second processing circuit, configured to output a target grey value of each sub-pixel of the nth frame according to the adjusted original grey value of each sub-pixel of the nth frame, an original grey value of each sub-pixel of the (n−1)th frame and a look-up table; wherein the predetermined grey value is higher than the low grey value threshold and lower than the high grey value threshold and n is an integer higher than 2.

Optionally, the first obtaining circuit is used to obtain the original grey value of each sub-pixel of the nth frame from a first storage circuit.

Optionally, the driving device further comprises a first storage circuit, configured to obtain and store the original grey value of each sub-pixel of the (n+1)th frame after outputting the original grey value of each sub-pixel of the nth frame to the first obtaining circuit.

Optionally, the driving device further comprises a second storage circuit, configured to obtain and output the original grey value of each sub-pixel of the nth frame after outputting the original grey value of each sub-pixel of the (n−1)th frame to the second obtaining circuit.

Optionally, the second obtaining circuit is configured to obtain the original grey value of each sub-pixel of the (n−1)th frame from the second storage circuit.

According to an embodiment of the present invention, a liquid crystal display device having a driving device is disclosed. The driving device comprises: a first obtaining circuit, configured to obtain an original grey value of each sub-pixel of a (n+1)th frame and an original grey value of each sub-pixel of a nth frame; a first processing circuit, configured to compare the original grey value of each sub-pixel of the (n+1)th frame with a high grey value threshold, to compare the original grey value of each sub-pixel of the nth frame with a low grey value threshold, and to adjust the original grey value of each sub-pixel of the nth frame to be a predetermined grey value and output adjusted original grey value of each sub-pixel of the nth frame if the original grey value of each sub-pixel of the (n+1)th frame is higher than with the high grey value threshold and the original grey value of each sub-pixel of the nth frame is lower than the low grey value threshold; a second obtaining circuit, configured to obtain an original grey value of each sub-pixel of (n−1)th frame and the adjusted original grey value of each sub-pixel of the nth frame; and a second processing circuit, configured to output a target grey value of each sub-pixel of the nth frame according to the adjusted original grey value of each sub-pixel of the nth frame, an original grey value of each sub-pixel of the (n−1)th frame and a look-up table; wherein the predetermined grey value is higher than the low grey value threshold and lower than the high grey value threshold and n is an integer higher than 2.

Optionally, the first obtaining circuit is used to obtain the original grey value of each sub-pixel of the nth frame from a first storage circuit.

Optionally, the driving device further comprises a first storage circuit, configured to obtain and store the original grey value of each sub-pixel of the (n+1)th frame after outputting the original grey value of each sub-pixel of the nth frame to the first obtaining circuit.

Optionally, the driving device further comprises a second storage circuit, configured to obtain and output the original grey value of each sub-pixel of the nth frame after outputting the original grey value of each sub-pixel of the (n−1)th frame to the second obtaining circuit.

Optionally, the second obtaining circuit is configured to obtain the original grey value of each sub-pixel of the (n−1)th frame from the second storage circuit.

In contrast to the conventional art, an embodiment of the present invention provides a driving method, a driving device, and an LCD display. The original grey value of each sub-pixel of the N+1th frame is compared with a high grey value threshold and the original grey value of each sub-pixel of the Nth frame is compared with a low grey value threshold. If the original grey value of each sub-pixel of the (n+1)th frame is higher than with the high grey value threshold and the original grey value of each sub-pixel of the nth frame is lower than the low grey value threshold, then the original grey value of each sub-pixel of the nth frame is adjusted to be a predetermined grey value and the adjusted original grey value of each sub-pixel of the nth frame is outputted. And then, a target grey value of each sub-pixel of the nth frame is outputted according to the adjusted original grey value of each sub-pixel of the nth frame, an original grey value of each sub-pixel of the (n−1)th frame and a look-up table. The embodiment shortens the response time from switching from the nth frame to the (n+1)th frame when the original grey value of each sub-pixel of the (n+1)th frame is higher than with the high grey value threshold and the original grey value of each sub-pixel of the nth frame is lower than the low grey value threshold. This makes the sub-pixel of the (n+1)th frame could be efficiently charged and thus the luminance of the (n+1)th frame is raised. In addition, since the luminance increase of the (n+1)th frame is more than that of the nth frame, the contrast of the LCD display could be improved.

DETAILED DESCRIPTION OF PREFERRED EMBODIMENTS

To help a person skilled in the art better understand the solutions of the present disclosure, the following clearly and completely describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present disclosure.

Figure 1:
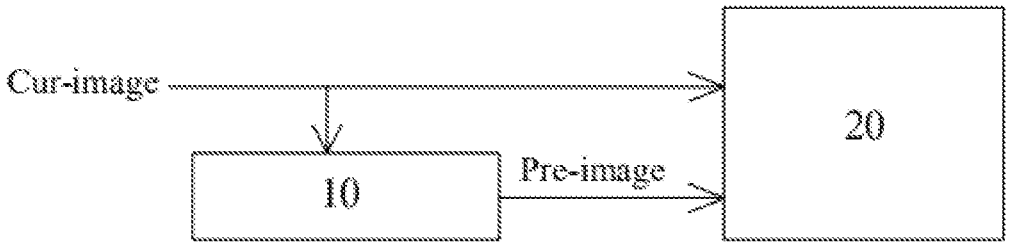
FIG. 1 is a diagram of a conventional over-driving module.
Figure 2:
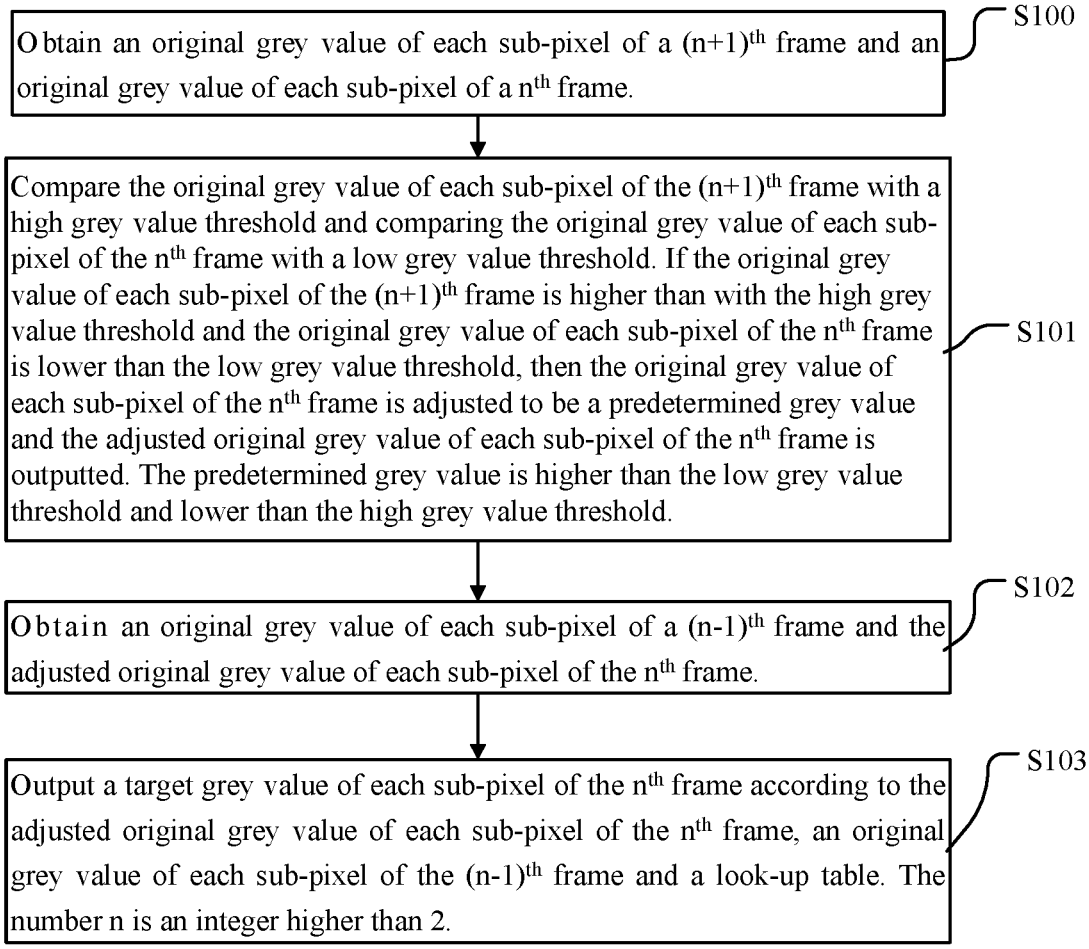
FIG. 2. Is a flow chart of a driving method according to an embodiment of the present invention.

Please refer to FIG. 2. FIG. 2. Is a flow chart of a driving method according to an embodiment of the present invention. The driving method could be executed by a timing controller. The driving method could be used in an LCD display device to drive the LCD display device to generate light. The driving method comprises following steps:

S100: obtaining an original grey value of each sub-pixel of a (n+1)th frame and an original grey value of each sub-pixel of a nth frame.

Specifically, when the nth frame is being displayed, the timing controller receives the image data of the (n+1)th frame sent by a front-end video processing circuit and obtains the original grey value of the nth frame from a first storage circuit. The image data of the (n+1)th frame comprises the original grey value of each sub-pixel of the (n+1)th frame.

The timing controller comprises the first storage circuit. When the nth frame is being displayed, the first storage circuit stores the image data of the nth frame. The image data of the nth frame comprises the original grey value of each sub-pixel of the nth frame. The image data of the nth frame is sent by the front-end video processing circuit when the (n−1)th frame is being display and the timing controller stores the image data of the nth frame in the first storage circuit. The first storage circuit could be a frame buffer. After the first storage circuit outputs the image data of the previous frame, the first storage circuit obtains and stores the image data of the current frame.

Furthermore, after the original grey value of each sub-pixel of the nth frame is obtained from the first storage circuit, the image data of each sub-pixel of the (n+1)th frame is stored in the first storage circuit. That is, the original grey value of each sub-pixel of the nth frame is stored in the first storage circuit.

Each frame comprises a plurality of pixels. Each of the pixels comprises a red sub-pixel, a blue sub-pixel and a green sub-pixel. The red sub-pixel, the blue sub-pixel and the green sub-pixel has a grey value from 0 to 255. Here, the grey value 0 represents a minimum grey value and grey value 255 represents a maximum grey value.

S101: comparing the original grey value of each sub-pixel of the (n+1)th frame with a high grey value threshold and comparing the original grey value of each sub-pixel of the nth frame with a low grey value threshold. If the original grey value of each sub-pixel of the (n+1)th frame is higher than with the high grey value threshold and the original grey value of each sub-pixel of the nth frame is lower than the low grey value threshold, then the original grey value of each sub-pixel of the nth frame is adjusted to be a predetermined grey value and the adjusted original grey value of each sub-pixel of the nth frame is outputted. Here, the predetermined grey value is higher than the low grey value threshold and lower than the high grey value threshold.

Here, the original grey value of each sub-pixel of the (n+1)th frame is compared with the high grey value threshold and the original grey value of the corresponding sub-pixel of the nth frame is compared with the low grey value threshold to determine if the original grey value of each sub-pixel of the (n+1)th frame and the original grey value of the corresponding sub-pixel of the nth frame meet a predetermine condition. If the predetermined condition is met, then the original grey value of the corresponding sub-pixel of the nth frame is adjusted to be the predetermined grey value, which is higher than the low grey value threshold and lower than the high grey value threshold. Otherwise, the original grey value of the corresponding sub-pixel of the nth frame is not adjusted.

For example, the high grey value threshold is 235, the low grey value threshold is 15, and the predetermined grey value is 50. The original grey value of a red sub-pixel of the (n+1)th frame is 240 and the original grey value corresponding to the red sub-pixel of the nth frame is 10. In this example, the original grey value corresponding to the red sub-pixel of the nth frame is adjusted to be 50. The original grey value of a blue sub-pixel of the (n+1)th frame is 245 and the original grey value corresponding to the blue sub-pixel of the nth frame is 6. In this example, the original grey value corresponding to the blue sub-pixel of the nth frame is adjusted to be 50. The original grey value of a green sub-pixel of the (n+1)th frame is 225 and the original grey value corresponding to the green sub-pixel of the nth frame is 5. In this example, the original grey value corresponding to the blue sub-pixel of the nth frame is not adjusted and thus the original grey value 5 corresponding to the blue sub-pixel of the nth frame is outputted.

In this embodiment, the high grey value threshold, the low grey value threshold, the predetermined grey value are set according to the type of the LCD display device, the type of the liquid crystals, and other conditions. In addition, the red sub-pixel, the blue sub-pixel and the green sub-pixel could have the same or different high grey value thresholds, low grey value thresholds, and predetermined grey values. These values could be adjusted based on the actual implementations. The high grey value threshold is lower than 255, the low grey value threshold is higher than 0, and the predetermined grey value is higher than 0 and lower than 255.

For a sub-pixel, if its original grey value of the nth frame and its original grey value of the (n+1)th frame meet the predetermined condition, then its original grey value of the nth frame becomes the predetermined grey value. In this way, it only requires a shorter response time for switching the sub-pixel of the nth frame from the nth frame to the (n+1)th frame. This arrangement is better for charging the sub-pixel when the (n+1)th frame is being displayed and increases the luminance of the sub-pixel of the (n+1)th frame.

The LCD display device comprises a plurality of pixels. Each of the pixels comprises a red sub-pixel, a blue sub-pixel and a green sub-pixel. When the LCD display device switches from the previous frame to the current frame, the LCD display displays a sub-pixel of the current frame after displaying the corresponding sub-pixel of the previous frame.

S102: obtaining an original grey value of each sub-pixel of a (n−1)th frame and the adjusted original grey value of each sub-pixel of the nth frame.

Here, the original grey value of each sub-pixel of the (n−1)th frame is obtained from the second storage circuit. In addition, the adjusted original grey value of each sub-pixel of the nth frame outputted in step S101 is obtained. The adjusted original grey value of each sub-pixel of the nth frame comprises those adjusted values when the predetermined condition is met and those unadjusted value when the predetermined condition is not met.

The timing controller comprises the second storage circuit. When the nth frame is being displayed, the second storage circuit stores the image data of the (n−1)th frame. The image data of the (n−1)th frame comprises the original grey value of each sub-pixel of the (n−1)th frame. After the storage circuit obtains the original grey value of each sub-pixel of the (n−1)th frame, the driving method further comprises storing the original grey value of each sub-pixel of the nth frame into the second storage circuit.

S103: outputting a target grey value of each sub-pixel of the nth frame according to the adjusted original grey value of each sub-pixel of the nth frame, an original grey value of each sub-pixel of the (n−1)th frame and a look-up table. The number n is an integer higher than 2.

The look-up table mentioned in the driving method shown in FIG. 2 is as the table 1 below.

TABLE 1

| Look-up Table | | | | | | | | | | | | | | | | | | |
|---|---|---|---|---|---|---|---|---|---|---|---|---|---|---|---|---|---|---|
| | 0 | 8 | 16 | 24 | 32 | 48 | 64 | 80 | 96 | 128 | 144 | 160 | 176 | 192 | 208 | 224 | 240 | 255 |
| 0 | 0 | 0 | 0 | 0 | 0 | 0 | 0 | 0 | 0 | 0 | 0 | 0 | 0 | 0 | 0 | 0 | 0 | 0 |
| 8 | 18 | 8 | 8 | 6 | 5 | 4 | 4 | 3 | 3 | 3 | 3 | 3 | 3 | 3 | 2 | 2 | 2 | 0 |
| 16 | 51 | 41 | 16 | 13 | 11 | 9 | 9 | 7 | 7 | 7 | 6 | 6 | 6 | 6 | 5 | 5 | 4 | 1 |

TABLE 1-continued

| | Look-up Table | | | | | | | | | | | | | | | | | |
|---|---|---|---|---|---|---|---|---|---|---|---|---|---|---|---|---|---|---|
| | 0 | 8 | 16 | 24 | 32 | 48 | 64 | 80 | 96 | 128 | 144 | 160 | 176 | 192 | 208 | 224 | 240 | 255 |
| 24 | 68 | 57 | 44 | 24 | 21 | 17 | 15 | 11 | 11 | 9 | 8 | 8 | 7 | 7 | 7 | 6 | 5 | 2 |
| 32 | 75 | 70 | 52.5 | 45 | 32 | 26 | 21 | 15 | 15 | 11 | 11 | 10 | 9 | 9 | 9 | 8 | 7 | 3 |
| 48 | 86 | 75 | 63 | 58 | 53 | 48 | 40 | 28 | 28 | 20 | 18 | 16 | 14 | 13 | 12 | 11 | 9 | 6 |
| 64 | 105 | 96 | 84 | 83 | 79 | 72 | 64 | 50 | 50 | 37 | 32 | 28 | 22 | 20 | 17 | 15 | 13 | 11 |
| 80 | 125 | 120 | 107 | 107 | 100 | 94 | 86 | 74 | 74 | 62 | 59 | 50 | 46 | 43 | 38 | 32 | 28 | 25 |
| 96 | 142 | 135 | 130 | 125 | 121 | 114 | 107 | 96 | 96 | 85 | 80 | 74 | 70 | 64 | 60 | 53 | 48 | 44 |
| 112 | 153 | 149 | 145 | 141 | 137 | 132 | 126 | 118 | 118 | 106 | 102 | 95 | 90 | 83 | 78 | 72 | 64 | 58 |
| 128 | 167 | 164 | 162 | 159 | 156 | 153 | 148 | 138 | 138 | 128 | 123 | 118 | 115 | 108 | 103 | 96 | 88 | 77 |
| 144 | 182 | 180 | 178 | 175 | 172 | 168 | 163 | 156 | 156 | 147 | 144 | 140 | 136 | 129 | 125 | 120 | 110 | 100 |
| 160 | 198 | 195 | 192 | 190 | 188 | 184 | 182 | 175 | 175 | 168 | 164 | 160 | 156 | 154 | 148 | 142 | 135 | 132 |
| 176 | 212 | 209 | 207 | 205 | 203 | 200 | 198 | 191 | 191 | 185 | 181 | 179 | 176 | 173 | 168 | 164 | 155 | 150 |
| 192 | 225 | 223 | 222 | 221 | 220 | 218 | 215 | 210 | 210 | 204 | 203 | 198 | 195 | 192 | 189 | 184 | 178 | 172 |
| 208 | 233 | 230 | 228 | 227 | 227 | 225 | 223 | 222 | 222 | 222 | 218 | 216 | 213 | 211 | 208 | 204 | 198 | 191 |
| 224 | 238 | 237 | 236 | 235 | 235 | 235 | 234 | 232 | 232 | 231 | 230 | 230 | 228 | 227 | 227 | 224 | 220 | 215 |
| 240 | 250 | 250 | 250 | 248 | 246 | 245 | 244 | 245 | 245 | 244 | 244 | 246 | 244 | 244 | 244 | 242 | 240 | 237 |
| 255 | 255 | 255 | 255 | 255 | 255 | 255 | 255 | 255 | 255 | 255 | 255 | 255 | 255 | 255 | 255 | 255 | 255 | 255 |

The first column in the table 1 is the grey value of a sub-pixel of the previous frame. The first row is the grey value of the corresponding sub-pixel of the current frame. The cross-section of the first row and the first column is the target grey value of the corresponding sub-pixel of the current frame. According to the target value, the data voltage of the corresponding sub-pixel of the current frame is outputted. For example, the original grey value of a sub-pixel the (n−1)th frame is 32. The adjusted original grey value of the sub-pixel of the nth frame is 48. The target grey value of the sub-pixel of the nth frame is 53. This means that the data voltage corresponding to the target grey value 53 is outputted to drive the LCD display device to display the sub-pixel of the current frame.

Figure 3:
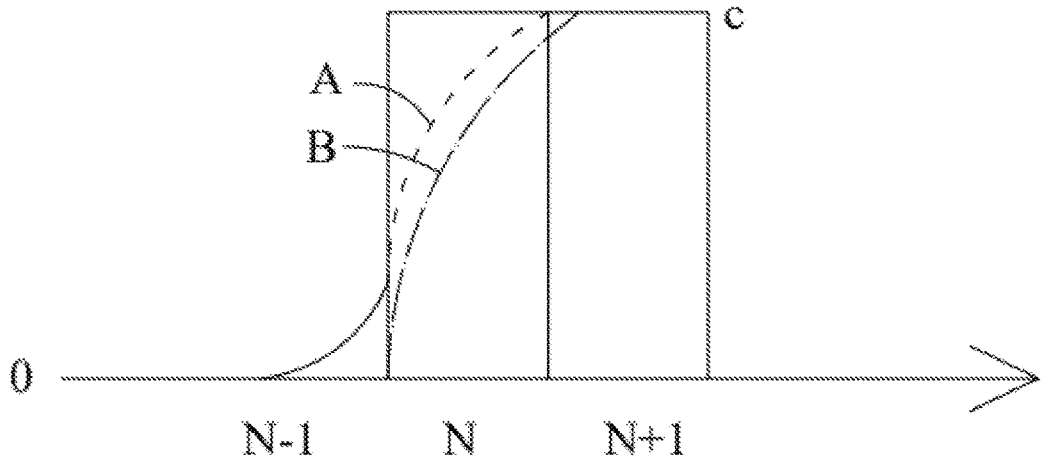
FIG. 3 is a response time of liquid crystals of the driving method shown in FIG. 2 and the conventional driving method.

Please refer to FIG. 3. FIG. 3 is a response time of liquid crystals of the driving method shown in FIG. 2 and the conventional driving method. The original grey value of a sub-pixel of the (n−1)th frame and the original grey value of the sub-pixel of the nth frame are both 0. The original grey value c of the sub-pixel of the (n+1)th frame is higher than the high grey value threshold and the original grey value 0 of the sub-pixel of the nth frame is lower than the high grey value threshold. According to the conventional driving method, the driving curve is shown as the curve B in FIG. 3. Because the refreshing frequency is too high, the charging time is not enough when the display needs to display the sub-pixel from the grey value 0 of the nth frame to the grey value c of the (n+1)th frame. As shown in the curve A in FIG. 3, the driving method according to an embodiment of the present invention could adjust the original grey value of the (n−1)th frame from the value 0 to the predetermined grey value and then switch from the predetermined grey value to the grey value c of the nth frame. This shortens the response time, ensures the corresponding sub-pixel of the (n+1)th frame could be efficiently charged, and raises the luminance the corresponding sub-pixel of the (n+1)th frame.

In this embodiment, the driving method raises the original grey value of the sub-pixel of the nth frame if the original grey value of the sub-pixel of the (n+1)th frame is higher than with the high grey value threshold and the original grey value of the sub-pixel of the nth frame is lower than the low grey value threshold. That is, the original grey value of the sub-pixel of the nth frame is raised when the switch from the sub-pixel of the previous frame to the sub-pixel of the current frame is from a dark image to a bright image. This allows the response time from switching from the nth frame to the (n+1)th frame could be shorter, makes the sub-pixel of the (n+1)th frame could be efficiently charged and thus the luminance of the (n+1)th frame is raised. In addition, since the luminance increase of the (n+1)th frame is more than that of the nth frame, the contrast of the LCD display could be improved.

According to the conventional art, assume the original grey value of a sub-pixel of the previous frame is 0 and the original grey value of the sub-pixel of the current frame is 255. When the sub-pixel is switched from the grey value 0 of the previous frame to the grey value 255 of the current frame, the response time of the liquid crystals is not enough and thus the display quality is not good because the sub-pixel is not pre-charged for the grey value 255 of the current frame. In contrast, in this embodiment, the driving method adjusts the grey value 0 to be the predetermined grey value between 0 and 255. This shortens the required response time for charging the sub-pixel to the level corresponding to the grey value 255 and thus raises the luminance of the sub-pixel.

Figure 4:
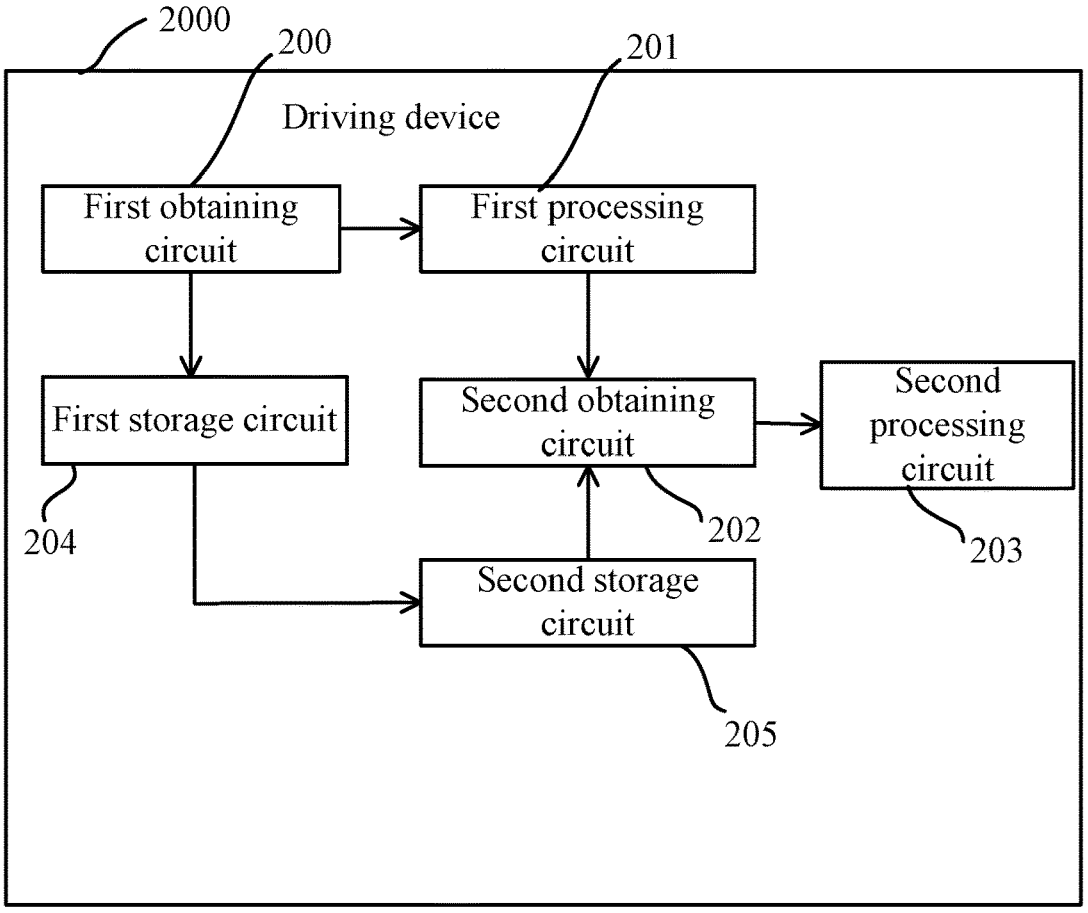
FIG. 4 is a diagram of a driving device according to an embodiment of the present invention.

Please refer to FIG. 4. FIG. 4 is a diagram of a driving device according to an embodiment of the present invention. The driving device 2000 is a timing controller. The driving device comprises a first obtaining circuit 200, a first processing circuit 201, a second obtaining circuit 202, a second processing circuit 203, a first storage circuit 204 and a second storage circuit 205.

The first obtaining circuit 200 is used to obtain the original grey value of each sub-pixel of the (n+1)th frame and an original grey value of each sub-pixel of the nth frame. Specifically, the first obtaining circuit 200 is used to obtain the original grey value of each sub-pixel of the nth frame from a first storage circuit 204. Furthermore, the first obtaining circuit 200 is used to receive the image data of the (n+1)th frame sent by a front-end video processing circuit. The image data comprises the original grey value of each sub-pixel of the (n+1)th frame.

The processing circuit 201 is used to compare the original grey value of each sub-pixel of the (n+1)th frame with the high grey value threshold, to compare the original grey value of each sub-pixel of the nth frame with a low grey value threshold, and to adjust the original grey value of each sub-pixel of the nth frame to be the predetermined grey value and output adjusted original grey value of each sub-pixel of the nth frame if the original grey value of each sub-pixel of the (n+1)th frame is higher than with the high grey value threshold and the original grey value of each sub-pixel of the nth frame is lower than the low grey value threshold. Here, the predetermined grey value is higher than the low grey value threshold and lower than the high grey value threshold.

The second obtaining circuit 202 is used to obtain the original grey value of each sub-pixel of the (n−1)th frame and the adjusted original grey value of each sub-pixel of the nth frame. Specifically, the second obtaining circuit 202 is used to obtain the image data of each sub-pixel of the (n−1)th frame from the second storage circuit 205. That is, the second obtaining circuit 202 is used to obtain the original grey value of each sub-pixel of the (n−1)th frame from the second storage circuit 205. In addition, the second obtaining circuit 202 is used to obtain the adjusted original grey value of each sub-pixel of the nth frame outputted by the first processing circuit 201.

The second processing circuit 203 is used to output a target grey value of each sub-pixel of the nth frame according to the adjusted original grey value of each sub-pixel of the nth frame, an original grey value of each sub-pixel of the (n−1)th frame and a look-up table. Here, the number n is an integer higher than 2.

The first storage circuit 204 is a frame buffer. The first storage circuit 204 is used to obtain and store the original grey value of each sub-pixel of the (n+1)th frame after outputting the original grey value of each sub-pixel of the nth frame to the first obtaining circuit 200.

The second storage circuit 205 is a frame buffer. The second storage circuit 205 is used to obtain and output the original grey value of each sub-pixel of the nth frame after outputting the original grey value of each sub-pixel of the (n−1)th frame to the second obtaining circuit.

In this embodiment, the driving device raises the original grey value of the sub-pixel of the nth frame if the original grey value of the sub-pixel of the (n+1)th frame is higher than with the high grey value threshold and the original grey value of the sub-pixel of the nth frame is lower than the low grey value threshold. That is, the original grey value of the sub-pixel of the nth frame is raised when the switch from the sub-pixel of the previous frame to the sub-pixel of the current frame is from a dark image to a bright image. This allows the response time from switching from the nth frame to the (n+1)th frame could be shorter, makes the sub-pixel of the (n+1)th frame could be efficiently charged and thus the luminance of the (n+1)th frame is raised. In addition, since the luminance increase of the (n+1)th frame is more than that of the nth frame, the contrast of the LCD display could be improved.

In this embodiment, the first obtaining 200, the first processing circuit 201, the second obtaining circuit 203 and the second processing circuit 204 of the driving device 20 are arranged by their functions. However, the arrangement of the driving device 20 is not limited. For example, the first obtaining circuit 200 and the first processing circuit 201 could belong to the pre-processing module. The second obtaining circuit 203 and the second processing circuit 204 could belong to the over-driving module.

In addition, an LCD display device is disclosed. The LCD display device comprises the above-mentioned driving device, a source driver, a gate driver and an LCD panel. The driving device is electrically connected to the source driver and the gate driver. The source driver is electrically connected to the LCD panel. The gate driver is also electrically connected to the LCD panel.

The source driver provides data voltages through multiple data lines to drive the pixels of the LCD panel to generate light. The gate driver provides a scan signal through the gate line to orderly control the pixels of the LCD panel to generate light. The driving device is used to provide control signals to the source driver and the gate drivers to control the LCD panel to generate light.

The driving device of the LCD display device outputs the target grey value of the nth frame according to the original grey value of the nth frame, the original grey value of the (n−1)th frame and the look-up table. This improves the luminance of the sub-pixel of the nth frame, shortens the required charging time of the sub-pixel when the (n+1)th frame is being displayed. Thus, the sub-pixel of the (n+1)th frame could be efficiently charged and the luminance of the sub-pixel could be increased. In addition, since the luminance increase of the (n+1)th frame is more than that of the nth frame, the contrast of the LCD display could be improved.

Above are embodiments of the present invention, which does not limit the scope of the present invention. Any modifications, equivalent replacements or improvements within the spirit and principles of the embodiment described above should be covered by the protected scope of the invention.

What is claimed is:

1. A driving method, comprising:

obtaining an original grey value of each sub-pixel of a (n+1)th frame and an original grey value of each sub-pixel of a nth frame;

comparing the original grey value of each sub-pixel of the (n+1)th frame with a high grey value threshold and comparing the original grey value of each sub-pixel of the nth frame with a low grey value threshold;

if the original grey value of each sub-pixel of the (n+1)th frame is higher than with the high grey value threshold and the original grey value of each sub-pixel of the nth frame is lower than the low grey value threshold, then adjusting the original grey value of each sub-pixel of the nth frame to be a predetermined grey value and outputting adjusted original grey value of each sub-pixel of the nth frame;

obtaining an original grey value of each sub-pixel of a (n−1)th frame and the adjusted original grey value of each sub-pixel of the nth frame; and outputting a target grey value of each sub-pixel of the nth frame according to the adjusted original grey value of each sub-pixel of the nth frame, an original grey value of each sub-pixel of the (n−1)th frame and a look-up table;

wherein the predetermined grey value is higher than the low grey value threshold and lower than the high grey value threshold and n is an integer higher than 2, wherein the red sub-pixel, the blue sub-pixel and the green sub-pixel have the same high grey value thresholds, low grey value thresholds, and predetermined grey values.

2. The driving method of claim 1, wherein the step of obtaining the original grey value of each sub-pixel of the (n+1)th frame and the original grey value of each sub-pixel of the nth frame comprises:

obtaining the original grey value of each sub-pixel of the nth frame from a first storage circuit.

3. The driving method of claim 2, further comprising:

after obtaining the original grey value of each sub-pixel of the nth frame from a first storage circuit, storing the original grey value of each sub-pixel of the (n+1)th frame into the first storage circuit.

4. The driving method of claim 2, wherein the step of obtaining the original grey value of each sub-pixel of (n−1)th frame and the adjusted original grey value of each sub-pixel of the nth frame comprises:

obtaining the original grey value of each sub-pixel of the (n−1)th frame from a second storage circuit.

5. The driving method of claim 4, further comprising:

after obtaining the original grey value of each sub-pixel of the (n−1)th frame from a second storage circuit, outputting the original grey value of each sub-pixel of the nth frame to the second storage circuit.

6. A driving device, comprising:

a first obtaining circuit, configured to obtain an original grey value of each sub-pixel of a (n+1)th frame and an original grey value of each sub-pixel of a nth frame;

a first processing circuit, configured to compare the original grey value of each sub-pixel of the (n+1)th frame with a high grey value threshold, to compare the original grey value of each sub-pixel of the nth frame with a low grey value threshold, and to adjust the original grey value of each sub-pixel of the nth frame to be a predetermined grey value and output adjusted original grey value of each sub-pixel of the nth frame if the original grey value of each sub-pixel of the (n+1)th frame is higher than with the high grey value threshold and the original grey value of each sub-pixel of the nth frame is lower than the low grey value threshold;

a second obtaining circuit, configured to obtain an original grey value of each sub-pixel of a (n−1)th frame and the adjusted original grey value of each sub-pixel of the nth frame; and a second processing circuit, configured to output a target grey value of each sub-pixel of the nth frame according to the adjusted original grey value of each sub-pixel of the nth frame, an original grey value of each sub-pixel of the (n−1)th frame and a look-up table;

wherein the predetermined grey value is higher than the low grey value threshold and lower than the high grey value threshold and n is an integer higher than 2, wherein the red sub-pixel, the blue sub-pixel and the green sub-pixel have the same high grey value thresholds, low grey value thresholds, and predetermined grey values.

7. The driving device of claim 6, wherein the first obtaining circuit is used to obtain the original grey value of each sub-pixel of the nth frame from a first storage circuit.

8. The driving device of claim 7, further comprising a first storage circuit, configured to obtain and store the original grey value of each sub-pixel of the (n+1)th frame after outputting the original grey value of each sub-pixel of the nth frame to the first obtaining circuit.

9. The driving device of claim 7, further comprising:

a second storage circuit, configured to obtain and output the original grey value of each sub-pixel of the nth frame after outputting the original grey value of each sub-pixel of the (n−1)th frame to the second obtaining circuit.

10. The driving device of claim 7, wherein the second obtaining circuit is configured to obtain the original grey value of each sub-pixel of the (n−1)th frame from the second storage circuit.

11. A liquid crystal display device comprising a driving device, the driving device comprising:

a first obtaining circuit, configured to obtain an original grey value of each sub-pixel of a (n+1)th frame and an original grey value of each sub-pixel of a nth frame;

a first processing circuit, configured to compare the original grey value of each sub-pixel of the (n+1)th frame with a high grey value threshold, to compare the original grey value of each sub-pixel of the nth frame with a low grey value threshold, and to adjust the original grey value of each sub-pixel of the nth frame to be a predetermined grey value and output adjusted original grey value of each sub-pixel of the nth frame if the original grey value of each sub-pixel of the (n+1)th frame is higher than with the high grey value threshold and the original grey value of each sub-pixel of the nth frame is lower than the low grey value threshold;

a second obtaining circuit, configured to obtain an original grey value of each sub-pixel of a (n−1)th frame and the adjusted original grey value of each sub-pixel of the nth frame; and a second processing circuit, configured to output a target grey value of each sub-pixel of the nth frame according to the adjusted original grey value of each sub-pixel of the nth frame, an original grey value of each sub-pixel of the (n−1)th frame and a look-up table;

wherein the predetermined grey value is higher than the low grey value threshold and lower than the high grey value threshold and n is an integer higher than 2, wherein the red sub-pixel, the blue sub-pixel and the green sub-pixel have the same high grey value thresholds, low grey value thresholds, and predetermined grey values.

12. The liquid crystal display device of claim 11, wherein the first obtaining circuit is used to obtain the original grey value of each sub-pixel of the nth frame from a first storage circuit.

13. The liquid crystal display device of claim 12, wherein the driving device further comprises a first storage circuit, configured to obtain and store the original grey value of each sub-pixel of the (n+1)th frame after outputting the original grey value of each sub-pixel of the nth frame to the first obtaining circuit.

14. The liquid crystal display device of claim 12, wherein the driving device further comprises:

a second storage circuit, configured to obtain and output the original grey value of each sub-pixel of the nth frame after outputting the original grey value of each sub-pixel of the (n−1)th frame to the second obtaining circuit.

15. The liquid crystal display device of claim 12, wherein the second obtaining circuit is configured to obtain the original grey value of each sub-pixel of the (n−1)th frame from the second storage circuit.

* * * * *